US005244032A

United States Patent [19]

Banksden et al.

[11] Patent Number: 5,244,032

[45] Date of Patent: Sep. 14, 1993

[54] ONE PIECE SPOUT SOCK AND CHANNEL BAG ASSEMBLY FOR ALUMINUM INGOT CASTING

[75] Inventors: David L. Banksden, Florence; Antonio F. Saavedra, Muscle Shoals, both of Ala.

[73] Assignee: Reynolds Metals Company, Richmond, Va.

[21] Appl. No.: 857,522

[22] Filed: Mar. 25, 1992

[51] Int. Cl.[5] ..... B22D 43/00

[52] U.S. Cl. ..... 164/134; 164/133; 266/230; 210/474; 210/499

[58] Field of Search ..... 164/133, 134, 337, 362, 164/437, 358; 266/227, 230; 222/591, 594; 210/467, 424, 427, 499, 503

[56] References Cited

U.S. PATENT DOCUMENTS

| | | | |
|---|---|---|---|
| 2,757,425 | 8/1956 | Duncan et al. | 164/134 |
| 2,876,509 | 3/1959 | Gardner | 164/134 |
| 3,779,389 | 12/1973 | Fant | 164/134 |
| 4,576,219 | 3/1986 | Uram | 164/134 |

FOREIGN PATENT DOCUMENTS

| | | | |
|---|---|---|---|
| 0212846 | 12/1983 | Japan | 164/134 |

OTHER PUBLICATIONS

Raffout et al., "Liquid Metal Distribution in a Slab DC Casting: Experiments and Modeling Approach", *Light Metals* 1991 (pp. 877-882).

*Primary Examiner*—Richard K. Siedel
*Assistant Examiner*—Erik R. Puknys
*Attorney, Agent, or Firm*—Alan M. Biddison

[57] ABSTRACT

A channel bag and a one piece spout sock and channel bag assembly for casting metal ingots. The channel bag includes diverter strips along upper portions of the sides and a diverter panel in the bottom of the channel bag positioned to be beneath a downspout during a casting process. The diverter strips and panel deflect poured molten metal and reduce turbulence during the casting process thereby reducing the formation of oxides and other impurities. In the one piece spout sock and channel bag assembly, the spout sock is utilized to receive and properly align a downspout. An ingot casting procedure utilizing the apparatus of the present invention reduces or eliminates the use of skimmers and ingot scalping.

29 Claims, 3 Drawing Sheets

FIG. 1
PRIOR ART
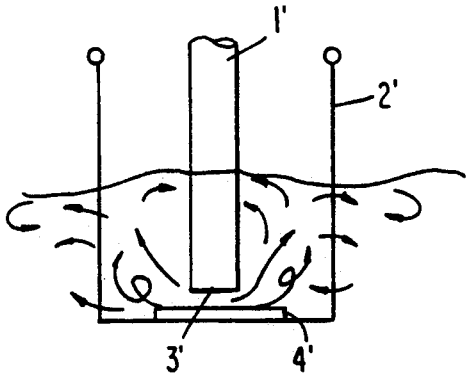
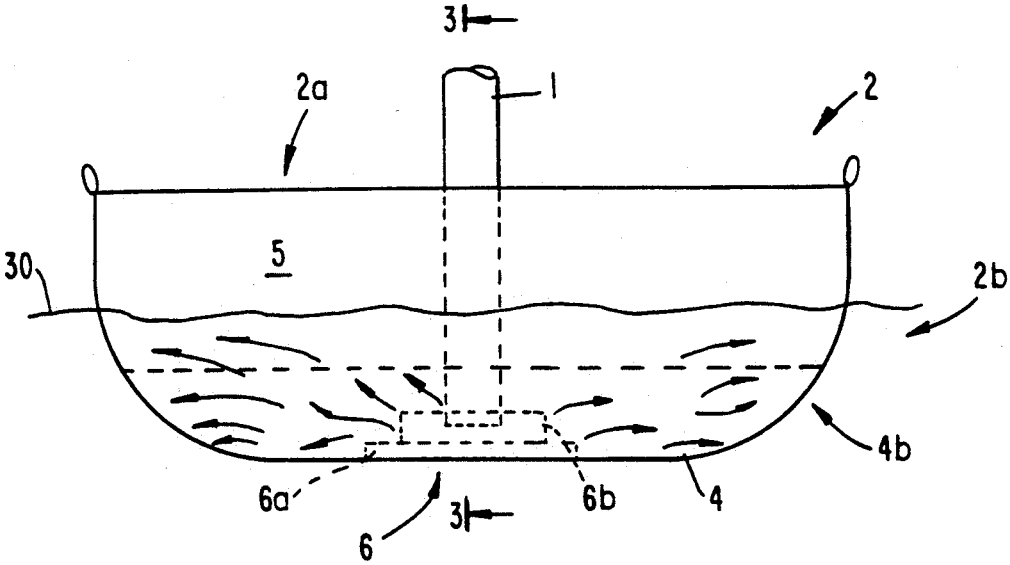
FIG. 2
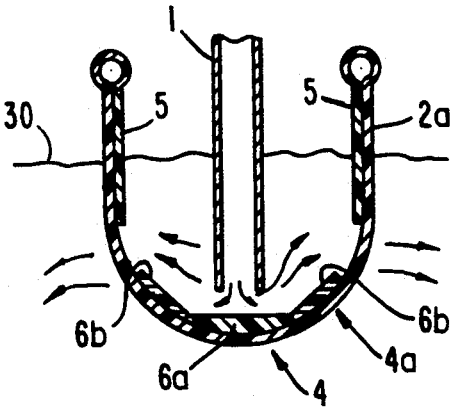
FIG. 3

ONE PIECE SPOUT SOCK AND CHANNEL BAG ASSEMBLY FOR ALUMINUM INGOT CASTING

TECHNICAL FIELD

The present invention relates to the casting of metal ingots. More particularly, the present invention relates to a method and apparatus for distributing molten metal during the casting of metal ingots.

BACKGROUND ART

In the production of aluminum alloy products, aluminum ingots are melted, alloyed and cast into ingots which are subjected to a variety of forming operations such as rolling, extruding, milling, etc.

A particular concern involved in the process of casting the molten metal into ingots is avoiding the formation of metal oxides and preventing slag or dross from entering the ingot mold and adversely affecting the quality of the ingot.

The design and type of pouring equipment, pouring temperature and pouring techniques are major factors in preventing slag or dross from entering the ingot mold, in minimizing gas or air entrapment, and in minimizing turbulence or splashing. Excessive contact with the atmosphere caused by turbulence and/or splashing results in the formation of oxides of the molten metal which often float to the top of the molten metal and have to be removed by complicated ingot head skimmers and mechanical skim dams. Once cooled and solidified, ingots which have their surfaces contaminated with impurities (oxides) often have to be "scalped" whereby the outer, contaminated portion of the ingot is removed.

Conventional ingot casting processes utilize distribution or channel bags and spout socks which are designed to direct the flow of molten metal uniformly on the ingot head. The spout sock and distribution or channel bags are two separate assemblies which have to be properly aligned so that the molten metal can be transferred into the distribution or channel bag for uniform distribution into the ingot mold. In order to aid in uniformly distributing the molten metal into the ingot mold, it is known to include bottom diverters in the distribution or channel bags.

Various disadvantages are associated with the prior art distribution or channel bags including poor distribution of the molten metal and excessive turbulence which occurs when the molten metal is distributed into the ingot mold. Moreover, prior art bags promote oxide film build up on ingot head and the resulting heavy oxide film is released in the form of large patches that affect deleteriously the ingot rolling faces. Excessive turbulence can result in the undesirable formation of a thick oxide film or layer on top of the molten aluminum. The turbulence also can break portions of the oxide layer loose so they are carried to the sides of the ingot being formed where they form defects requiring scalping. Another appreciable disadvantage with the prior art bags is the problem of properly aligning the spout sock with the distribution or channel bag so as to avoid any unnecessary turbulence when transferring molten metal into the distribution or channel bag.

The present invention is an improvement over the prior art and provides for a novel distribution bag and spout sock assembly which minimizes turbulence in the molten metal while providing for more even distribution of the molten metal in the ingot mold as well as reducing the accumulation of oxide film on the ingot head.

SUMMARY OF THE INVENTION

It is accordingly one object of the present invention to provide a channel bag for uniformly distributing molten metal into a mold.

It is a further object of the present invention to provide a channel bag which reduces turbulent flow in a molten metal while more evenly distributing the molten metal into a mold.

It is an even further object of the present invention to provide a unique, one piece spout sock and channel bag assembly for use in casting metal ingots.

It is a still further object of the present invention to provide a method for casting metal ingots.

It is a still further object of the present invention to provide a method for evenly distributing molten metal into a mold in a manner which avoids or reduces turbulence in the molten metal.

Yet another object of the present invention is to provide a spout sock and channel bag assembly that facilitates the controlled release of the oxide film that forms during casting before the thickness of the film becomes excessive.

According to the present invention there is provided a unique one piece spout sock and channel bag assembly for casting metal ingots which comprises an elongated mesh bag having an open top portion, a closed bottom portion, opposed side walls and end walls, and a spout sock attached to the center of the elongated bag.

Also provided by the present invention is a channel bag for use in casting metal ingots which comprises an elongated mesh bag having an open top portion, a closed bottom portion, opposed side walls and end walls, first means to divert material flow entering through the open top portion of the bag towards the ends of the bag, and second means to divert material flowing downwardly into the bag towards the side and end walls of the bag.

The present invention also provides for a method for casting metal ingots from a molten metal which comprises pouring molten metal from a downspout into a channel bag and controlling turbulence of the molten metal in the channel bag by diverting the poured molten metal towards end portions of the channel bag by diverting means which partially block flow of molten metal through upper side portions of the channel bag. In one embodiment, the method reduces turbulence in the molten metal so effectively that additional skimming of oxide accumulation on the ingot head and/or removal of solidified oxide layers by scalping is avoided.

BRIEF DESCRIPTION OF DRAWINGS

The present invention will now be described with reference to the annexed drawings, which are given by way of non-limiting examples only in which:

FIG. 1 is a schematic illustration of a conventional distribution bag of the prior art.

FIG. 2 is a schematic illustration of one embodiment of the distribution or channel bag of the present invention as viewed from one side thereof.

FIG. 3 is a cross-sectional view of the distribution or channel bag of FIG. 2 as viewed along the line III—III.

DESCRIPTION OF PREFERRED EMBODIMENTS

Figure 4:
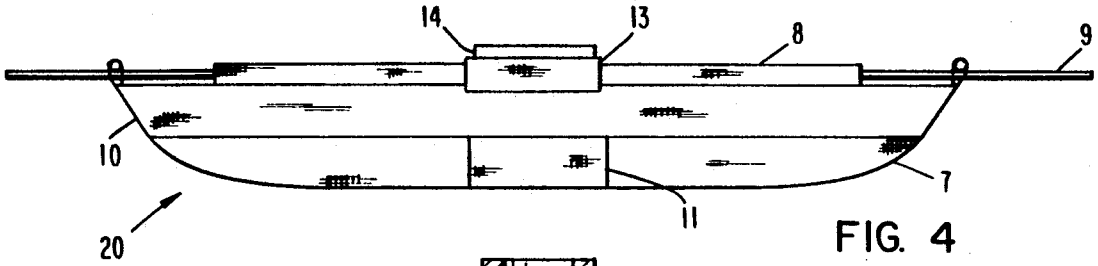
FIG. 4 is a schematic illustration of a one piece spout sock and distribution or channel bag according to another embodiment of the present invention as viewed from one side thereof.

The present invention relates to both a distribution or channel bag (hereafter referred to as a channel bag) and a one piece channel bag and a spout sock. The channel bag is uniquely structured to reduce turbulence in molten metal which is distributed by the channel bag into a mold.

The channel bag specifically reduces turbulent flow of molten metal by directing or diverting flow of the molten metal in horizontal laminar flow patterns below the surface of the melt.

The channel bag, which comprises an elongated mesh bag having an open top portion, a closed bottom portion and opposed side walls and end walls, includes first and second means for diverting material flow within the bag.

The first means for diverting material flow includes fine mesh side strips which block flow through the upper side portions of the channel bag which contribute to turbulent flow in the mold cavity. By blocking the molten metal flow through the upper side portions of the bag the flow is diverted towards the ends of the elongated bag and downward, with the excess oxide film being retained in the bag.

The second means for diverting material flow includes a bottom diverter which moderates the downward flow of the molten metal as it is delivered through the downspout and forces the molten metal to flow horizontally out the sides and ends of the channel bag. The bottom diverter includes a fine mesh bottom strip attached to the bottom of the channel bag.

FIG. 1 is a schematic illustration of a conventional channel bag. In use, a downspout 1' is aligned with the channel bag 2' so that the end 3' of the downspout is positioned below the surface of the molten metal in the mold. In order to distribute the flow of the molten metal within the mold, a bottom diverter 4' is conventionally utilized as illustrated.

The flow of the molten metal is illustrated by the arrows in FIG. 1. As seen in the figure, a significant amount of turbulence is created as the molten metal flows from the end of the downspout and is diverted or distributed by the bottom diverter. Such turbulence may adversely entrap air and/or disrupt the surface of the melt so as to cause oxidation of the metal.

FIGS. 2 and 3 schematically illustrate one embodiment of the channel bag of the present invention. According to this embodiment the channel bag 2 which may be made from a conventional fiber glass material is elongated and includes an open top portion, a closed bottom 4 and opposed side walls 2*a* and end walls 2*b*. The closed bottom 4 includes opposed curved portions 4*a*, adjacent sidewalls 2*a*, as best seen in FIG. 3, and opposed curved portions 4*b* adjacent end walls 2*b*, as shown in FIG. 2. By configuring the bottom 4 with curved portions 4*a* and 4*b*, sharp angles where the bottom and sidewalls meet are eliminated. The curved portions 4*a* and 4*b* reduce abrupt changes in flow patterns in the molten metal and, therefore, minimize breakage of the protective oxide and occurrence of imperfections in the ingot face.

In order to control the turbulence of molten metal poured into the channel bag, the channel bag includes first and second means for diverting material flow within the bag. The first means for diverting material flow includes fine mesh side strips or panels 5 which may be made of conventional fine-woven fiber glass materials. The second means for diverting material flow includes a uniquely shaped channel bag bottom diverter 6 as illustrated in FIG. 3. The bottom diverter includes a fine mesh bottom strip 6*a* attached to the center of the bottom of the channel bag as illustrated and may be made from conventional fine-woven fiber glass materials. Both the side strips 5 and the bottom diverter 6 are sewn, formed in, or otherwise attached inside the channel bag. The mesh size of both the side strips and bottom diverter is smaller than that of the channel bag so as to effectively block or inhibit a substantial portion of the flow of molten metal through the side strips and bottom diverter and thereby divert flow within the channel bag.

The particular shape of the channel bag bottom and diverter 6 includes a bottom portion 6*a* which extends across the width of the channel bag and particularly along the length of the channel bag in each direction from the center thereof as illustrated in FIGS. 2 and 3. As further illustrated, the bottom diverter 6 includes side portions 6*b* which are somewhat shorter in length than the bottom portion. These side portions extend upward toward the side strips 5 as illustrated in FIG. 3.

FIGS. 2 and 3 include arrows which illustrate the flow pattern of the molten metal. Since the flow of molten metal through the upper portions of the sides of the channel bag is effectively blocked by the side strips 5, the molten metal entering the channel bag from the downspout is forced out of the channel bag in a planar end-to-end direction as best illustrated in FIG. 2. This resulting end-to-end flow of the molten metal is essentially laminar flow. In addition to controlling the end-to-end flow of the molten metal by means of the side strips 5, the bottom diverter moderates the downward direction of the molten metal flow and forces the metal to flow horizontally out the lower portions of the sides of the channel bag as best illustrated in FIG. 3.

In use, the downspout 1 is centered in the channel bag at a depth that places the downspout below the surface of the molten metal 30 in the ingot head, for instance, about 1.5 to 2.0 inches. The channel bag itself is positioned such that the lower portion is approximately 2½ to 3 inches in the ingot head. In this arrangement the ingot head turbulence is substantially reduced to a level where high-Mg content alloys, e.g., 2.5 to 6.0 wt. % Mg, flow much like non-Mg containing alloys. Oxide generation on the ingot head is greatly reduced, eliminating or significantly reducing the need for subsequent ingot head skimmers and mechanical dams.

The channel bag of the present invention is relatively inexpensive to produce and is easily implemented into a casting shop. The channel bag allows casting of AA 5182-type alloys with the EMC process with an as-cast surface acceptable for rolling without ingot scalping.

Figure 5:
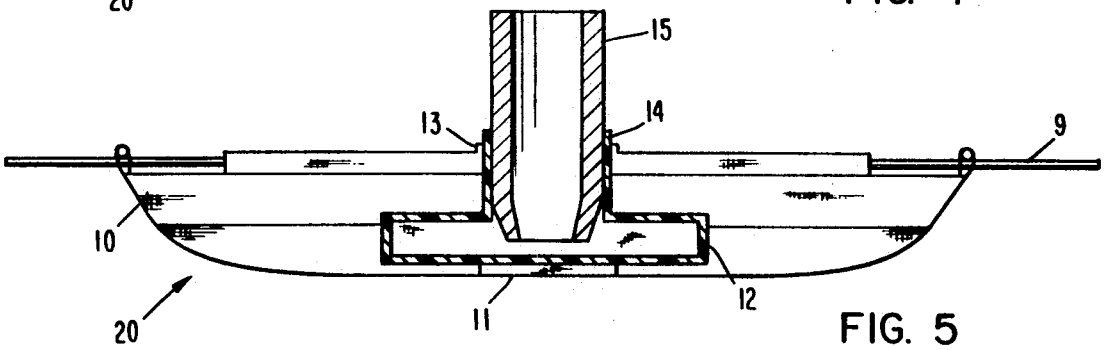
FIG. 5 is a schematic illustration of the one piece spout sock and distribution or channel bag of FIG. 4 in a cross-sectional view.
Figure 6:
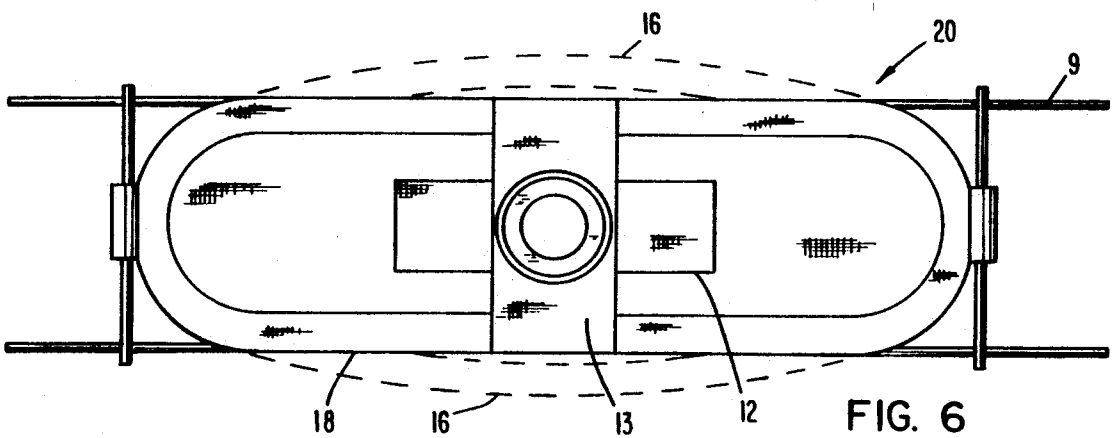
FIG. 6 is a schematic illustration of the one piece spout sock and distribution or channel bag of FIG. 4 as viewed from the top thereof.

Another embodiment of the one piece spout sock and channel bag assembly 20 of the present invention is illustrated in FIGS. 4–6. With reference to FIG. 4, the one piece spout sock and the channel bag assembly 20 includes a channel bag 7 having upper support means which, in one embodiment, comprise loops 8 sewn into the upper portion of the channel bag which are designed to receive support rods 9, e.g., steel rods, from which the channel bag may be suspended into an ingot mold. In other embodiments, the upper support means 8 may include fiber glass cords or metal clips which are attached to and support the channel bag.

As illustrated in FIGS. 4–6, the channel bag includes a finely-woven fiber glass side strip 10 similar to that discussed above. As further illustrated, the fiber glass side strip 10 includes a strip or band 18 which extends around the entire upper surface of the channel bag. This fiber glass strip or band is made of a finer mesh fiber glass cloth than the lower part of the channel bag and is utilized to assist in retaining the oxide film formed on the surface of the molten metal flowing into the channel bag.

During an ingot casting operation, the level of molten metal in the channel bag should be maintained above the lower part of the fiber glass strip or band in order to trap and maintain the oxide film on the surface of the molten metal in the channel bag. It has been discovered that the oxide film retained in the channel bag serves as a protective cover for the molten metal flowing underneath in the channel bag if metal is delivered into it with minimum turbulence. The oxide film protective cover inhibits oxidation of the molten metal surface such that oxidation occurs at a rate similar to the rate occurring at the beginning of the casting process.

In the embodiment illustrated in FIGS. 4–6, the channel bag also includes a bottom diverter 11 which comprises a fine-woven fiber glass panel which is centrally located in the bottom of the channel bag, as best seen in FIG. 5, and extends up the sides to the side strips 10 as illustrated in FIG. 4.

The one piece spout sock and channel bag assembly 20 includes a spout sock 12 which is attached to the channel bag by a fiber glass band 13. The spout sock is made from a woven fiber glass material having a sufficient mesh size opening to retain oxides and other undesirable particulate materials during a casting operation while allowing molten metal to pass therethrough. Attaching the spout sock 12 to the channel bag 7 by means of the fiber glass band 13 insures that the downspout 15 is properly aligned with the channel bag for even flow distribution when the downspout is inserted into the upper receiving portion 14 of the spout sock 12.

In a particular preferred embodiment, the channel bag 7 is made having long side walls which are curved slightly outward as indicated by the phantom lines 16 in FIG. 6. It has been discovered that the curved sides of the channel bag help breaking of the oxide film instead of permitting the oxide to build up on the ingot head outside the channel bag when electromagnetically casting certain aluminum alloys, particularly aluminum alloys with a high magnesium content, e.g., AA 5182 alloy. When utilizing the channel bag having curved sides it was observed that the flow of the oxide film followed the flow pattern of the metal so that there was substantially continuous movement of the oxide film rather than build up. When there was a change in the flow pattern because of non-curved sides, the oxide film tended to build up and suddenly release resulting in imperfections on the ingot face.

It was discovered that straight wall channel bags, presently used, produced a curved flow pattern in the oxide film, but the flow lines became parallel to the ingot face as these flow lines approached the meniscus. Eventually, the oxide film was in compression and it produced a much heavier oxide film. The result was the sudden appearance of longitudinal folds or creases on the surface where the thicker oxide film reached the ingot faces. The curved shape channel bag helped maintain proper surface tension in the thin oxide film that allowed this film to break up. It has also been discovered that shaping the channel bag with a curvature toward the rolling faces of the ingot assists in maintaining a more uniform flow of the thinner oxide film on the molten metal ingot head and minimizes or eliminates surface defects that result from the rupture in the continuity of the thicker oxide film that is generated when the film flow is restricted.

During a casting operation, the one piece spout sock and the channel bag assembly enables quick and proper alignment of the downspout with respect to the mold. The downspout 15 is inserted into the upper receiving portion 14 of the spout sock. As the molten metal flows down the downspout and into the fiber glass sock, the flow is diverted toward the end walls of the channel bag or short faces of the ingot for better distribution. In addition, the flow is also diverted so as to attenuate the molten metal turbulence. The spout sock also serves as an additional filter for the molten metal to retain undesirable oxides and/or particulate matter.

Also during a casting operation, the bottom diverter assists in diverting the flow of the molten metal towards the faces of the ingot and helps reduce the turbulence of the metal coming down the downspout before it is delivered to the head of the ingot being cast. In each embodiment, the channel bag should have an appropriate mesh size opening to allow the flow of molten metal into the ingot head. In a preferred process, the one piece spout sock and the channel bag assembly was found to be particularly advantageous for casting aluminum alloy ingots.

Figure 7:
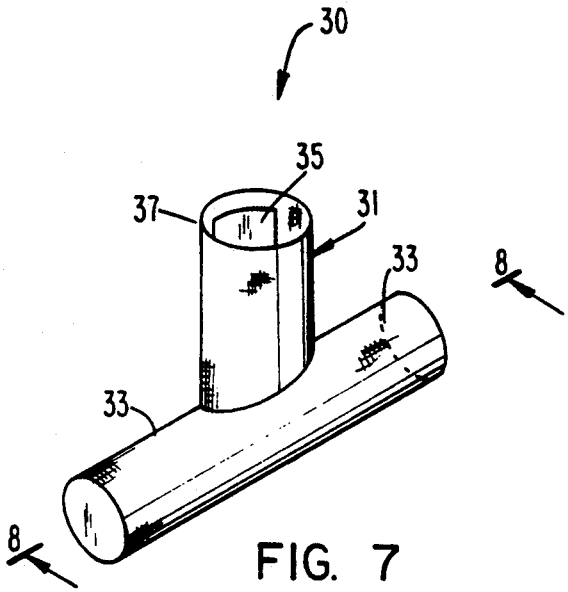
FIG. 7 is a perspective view of another embodiment of the present invention showing spout sock with diverter band.

In another embodiment of the present invention, a spout sock with diverter band is shown in FIG. 7 and generally designated by the reference numeral 30. The spout sock with diverter band includes a cylindrical upper portion 31 and a pair of opposed lower portions 33. The upper portion 31 is designed to receive a downspout in a similar manner as shown for the spout sock 12 and downspout 15 in FIG. 5.

Figure 8:
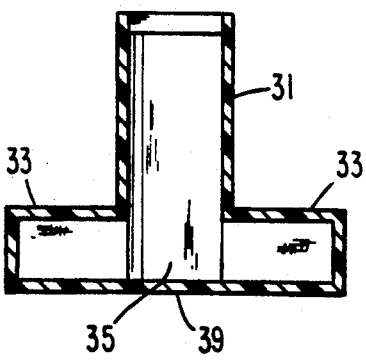
FIG. 8 is a cross-sectional view along the line A—A shown in FIG. 7.

With reference to FIGS. 7 and 8, the spout sock 30 includes a diverter band 35 which is disposed on an inside surface 37 of the upwardly extending portion 31 of the spout sock. When the spout sock with diverter band is fitted on a downspout, the diverter bands help to reduce turbulence inside the channel bag as the flow of metal is preferentially directed to the ends thereof. The diverter band 35, in a preferred embodiment, includes a fiberglass cloth band positioned on the inner surface of the spout sock. The diverter band 35 extends upwardly from the bottom surface 39 of the spout sock and along the inner surface 37 of the upwardly extending portion 31. A second diverter band (not shown) may also be included in the spout sock 30 in opposing relationship to the diverter band 35.

Numerous other modifications and alterations of the structure of the various elements which have been disclosed herein for purposes of illustration will be apparent to one skilled in the art, and it is obvious that the same may be made without departing from the spirit and scope of the invention as defined by the following claims.

We claim:

1. A channel bag for use in casting metal ingots which comprises an elongated mesh bag having an open top portion, a generally curved bottom portion and opposed side walls and end walls, said channel bag further comprising first means for diverting material flow entering through said open top portion of said bag towards the ends of said bag and second means for diverting material flowing downwardly into said bag towards said side and end walls of said bag, said second means for diverting comprising a fine mesh bottom strip attached to said bottom of said bag, said bottom strip being positioned in the center of said bottom of said bag and extending across the width of said bottom and extending at least partially across the side walls of said bag from said bottom of said bag towards said top of said bag, the mesh size of said bottom strip being smaller than the mesh size of said bag so as to at least inhibit flow of molten metal through said bottom strip.

2. A channel bag for casting metal ingots according to claim 1, wherein said first means for diverting comprises fine mesh side strips which are attached to said side walls of said bag, said side strips extending along said side walls and further extending from the open top portion of said bag toward said bottom of said bag, the mesh size of said side strips being smaller than the mesh size of said bag so as to at least inhibit flow of molten metal through said side strips.

3. A channel bag for casting metal ingots according to claim 2, wherein said elongated mesh bag comprises a fiber glass mesh and said first means for diverting comprises fiber glass mesh strips which are positioned on the inside of said bag.

4. A channel bag for casting metal ingots according to claim 1, wherein said second means for diverting comprises a fiber glass mesh strip which is positioned on the inside of said bag.

5. A one piece spout sock and channel bag for casting metal ingots which comprises an elongated mesh bag having an open top portion, a closed bottom portion and opposed side walls and end walls and a spout sock attached to the center of said elongated bag.

6. A one piece spout sock and channel bag for casting metal ingots according to claim 5 wherein said spout sock includes an upper sleeve portion which is attached to said bag by means of a band which extends across said top of said bag between said opposed side walls.

7. A one piece spout sock and channel bag for casting metal ingots according to claim 5, wherein said channel bag includes means for retaining metal oxide films within said bag during a casting operation and a bottom diverter means for diverting material flowing downwardly into said bag towards said side and end walls of said bag.

8. A one piece spout sock and channel bag for casting metal ingots according to claim 7, wherein said bottom diverter means comprises a fine mesh bottom strip attached to said bottom of said bag, said bottom strip being positioned in the center of said bottom of said bag and extending across the width of said bottom, the mesh size of said bottom strip being smaller than the mesh size of said bag so as to at least inhibit flow of molten metal through said bottom strip.

9. A one piece spout sock and channel bag for casting metal ingots according to claim 8, wherein said bottom diverter means further extends across each of said side walls of said bag from said bottom of said bag towards said top of said bag.

10. A one piece spout sock and channel bag for casting metal ingots according to claim 5, wherein said side walls of said bag are curved outwardly.

11. A method for casting metal ingots from a molten metal which comprises attaching a spout sock to a channel bag to provide a combined spout sock and channel bag, pouring molten metal from a downspout into the combined spout sock and channel bag and controlling turbulence of said molten metal in the channel bag by diverting said poured molten metal towards side and end portions of said channel bag by diverting means which partially block flow of molten metal through upper side portions of said channel bag.

12. A method for casting metal ingots from a molten metal according to claim 11, wherein said turbulence is further controlled by diverting said molten metal from a bottom portion of said channel bag and towards side and end walls of said channel bag.

13. A method for casting metal ingots from a molten metal according to claim 11, wherein during a casting procedure said spout sock receives, aligns and maintains alignment of said downspout with said channel bag.

14. A method for casting metal ingots from a molten metal according to claim 11, wherein the effects of surface tension of an oxide film within said channel bag are controlled so as to prevent said oxide film from growing thicker or unevenly compressing, the ingot being subjected to the force of an electromagnetic field.

15. A method for casting metal ingots from a molten metal according to claim 11, wherein said molten metal comprises an aluminum alloy.

16. A method for casting metal ingots from a molten metal according to claim 11, wherein the amount of oxides and other undesirable impurities is sufficiently low such that the method does not require skimming during casting or scalping the cast ingot.

17. The method for casting metal ingots from a molten metal according to claim 11, wherein said turbulence is further controlled by providing said channel bag with a generally curved bottom to minimize oxide build up on the ingot head and promote flow of oxide film toward the ingot faces.

18. The method for casting metal ingots from a molten metal according to claim 11, wherein said turbulence is further controlled by providing said channel bag with opposed generally curved sidewalls to minimize oxide build up on the ingot head and promote flow of oxide film toward the ingot faces.

19. The method for casting metal ingots from a molten metal according to claim 11, wherein said diverting step further controls turbulence in a head portion of said ingot.

20. The method of claim 11 wherein oxides and other undesirable contaminant generation in said molten metal are reduced by means of a spout sock having side-bands along downspout sides to force flow of molten metal toward the short sides of the channel bag.

21. The channel bag for casting metal ingots according to claim 3 wherein said fiber glass mesh strips are sewn on the inside of said bag.

22. The channel bag for casting metal ingots according to claim 2 wherein said side strips extend along the length of said side walls.

23. The channel bag for casting metal ingots accordingly to claim 2 wherein said side strips block flow of molten metal through said side strips.

24. The one piece spout sock and channel bag of claim 6 wherein said upper sleeve portion includes at least one diverter band attached to an inside surface of said sleeve portion to force molten metal toward ingot ends and induce a more undisturbed flow of molten metal.

25. The one piece spout sock and channel bag of claim 24 further comprising a pair of said diverter bands, said pair arranged on said inside surface in opposing relationship.

26. A channel bag for use in casting metal ingots which comprises an elongated mesh bag having a top portion, a generally curved bottom portion and opposed side walls and end walls, strip means extending downwardly from substantially all of the upper portions of said side walls toward said curved bottom portion for inhibiting flow of molten metal through upper portions of said side walls, means for diverting molten metal flowing downwardly into said bag towards said side walls and said end walls, at least a portion of said strip means being spaced from said means for diverting so that said strip means does not interfere with flow of molten metal through at least a part of lower portions of said side walls.

27. The channel bag of claim 26, further comprising strip means extending around the entire upper surface of said side walls and said end walls to inhibit flow of molten metal therethrough.

28. The channel bag of claim 27, wherein said means for diverting inhibits flow of molten metal across substantially all of the width of said bottom portion.

29. The channel bag of claim 26, wherein said side walls and said end walls are generally curved to assist in maintaining a uniform flow of oxide film on the surface of molten metal in an ingot head.

* * * * *